United States Patent [19]

Meyer

[11] 3,985,360

[45] Oct. 12, 1976

[54] GAME APPARATUS

[75] Inventor: Burton C. Meyer, Downers Grove, Ill.

[73] Assignee: Marvin Glass & Associates, Chicago, Ill.

[22] Filed: Sept. 15, 1975

[21] Appl. No.: 613,255

[52] U.S. Cl. ..... 273/109; 273/120 R

[51] Int. Cl.[2] ..... A63F 7/00

[58] Field of Search ..... 273/109, 110, 113, 115, 273/119 R, 120 R

[56] References Cited

UNITED STATES PATENTS

| | | | |
|---|---|---|---|
| 570,105 | 10/1896 | Ryan et al. | 273/110 UX |
| 2,248,859 | 7/1941 | Ferreri | 273/110 |
| 3,785,650 | 1/1974 | Halliburton | 273/110 |

FOREIGN PATENTS OR APPLICATIONS

| | | | |
|---|---|---|---|
| 819,666 | 7/1937 | France | 273/110 |

OTHER PUBLICATIONS

Crestline Brochure, p. 1 relied on, received Mar. 1970.

*Primary Examiner*—Anton O. Oechsle
*Attorney, Agent, or Firm*—Coffee & Sweeney

[57] ABSTRACT

A competitive game wherein a ball is rollably supported upon two spreadable rods above a base including scoring receptacles beneath the rods. The rods are supported by end walls through apertures therein. Terminal handles are attached, one on each end of each rod for the two opposing players to vary the space between the rods thereby moving the ball therealong. The receptacles are designated as favorable or unfavorable to a respective player. The object of the game is for each player to deposit the ball into a favorable receptacle in opposition to the adverse maneuvers of the opposing player. A scorekeeping means in the form of a peg movable between successive apertures corresponding to the point score of that player is provided.

10 Claims, 4 Drawing Figures

GAME APPARATUS

BACKGROUND OF THE INVENTION

This invention relates to game devices and, in particular, to competitive action game devices wherein the movement of a rolling ball is controlled by the manipulation of two spreadable rods positioned above a base having scoring receptacles.

A game device utilizing two support rods to support a ball are well known in the prior art. However, such devices have always anchored the rods at one end so that only the other ends are movable to move the ball and position it for scoring. Examples of such devices are shown in Benson U.S. Letters Pat. No. 145,385 issued Dec. 9, 1873; Ryan et al. U.S. Letters Pat. No. 570,105 issued Oct. 27, 1896; and Carlson U.S. Letters Pat. No. 1,595,071 issued Aug. 10, 1926. The anchoring of one of the rods in these prior art devices limits participation in that only one player at a time may manipulate the rods. This decreases the competitive aspect of the game and eliminates the need for dexterity and skill to a certain extent. There is a continuing need and desire in the game art to provide games of such a character that will captivate the interest of the participants and hold their interest for an extended period of time. It is to the satisfaction of this end and desire that the present invention is directed.

SUMMARY OF THE INVENTION

The present competitive game invention relates to a playing base including receptacle compartments. A ball is supported above the base by two approximately parallel rails along which it can be made to roll. Two opposed players, one on each end of the playing base manually vary the distances between the rails to try to cause the ball to roll or to fall into a receptacle compartment favorable to that player and thereby score. The player with the highest score wins the game. The game requires skill and agility to guide the ball to a desired position in the face of the adverse actions of the opposing player.

Other objects, features and advantages of the invention will be apparent from the following detailed description taken in connection with the accompanying drawings.

DESCRIPTION OF THE PREFERRED EMBODIMENT

Figures 1, 2, 3, 4:
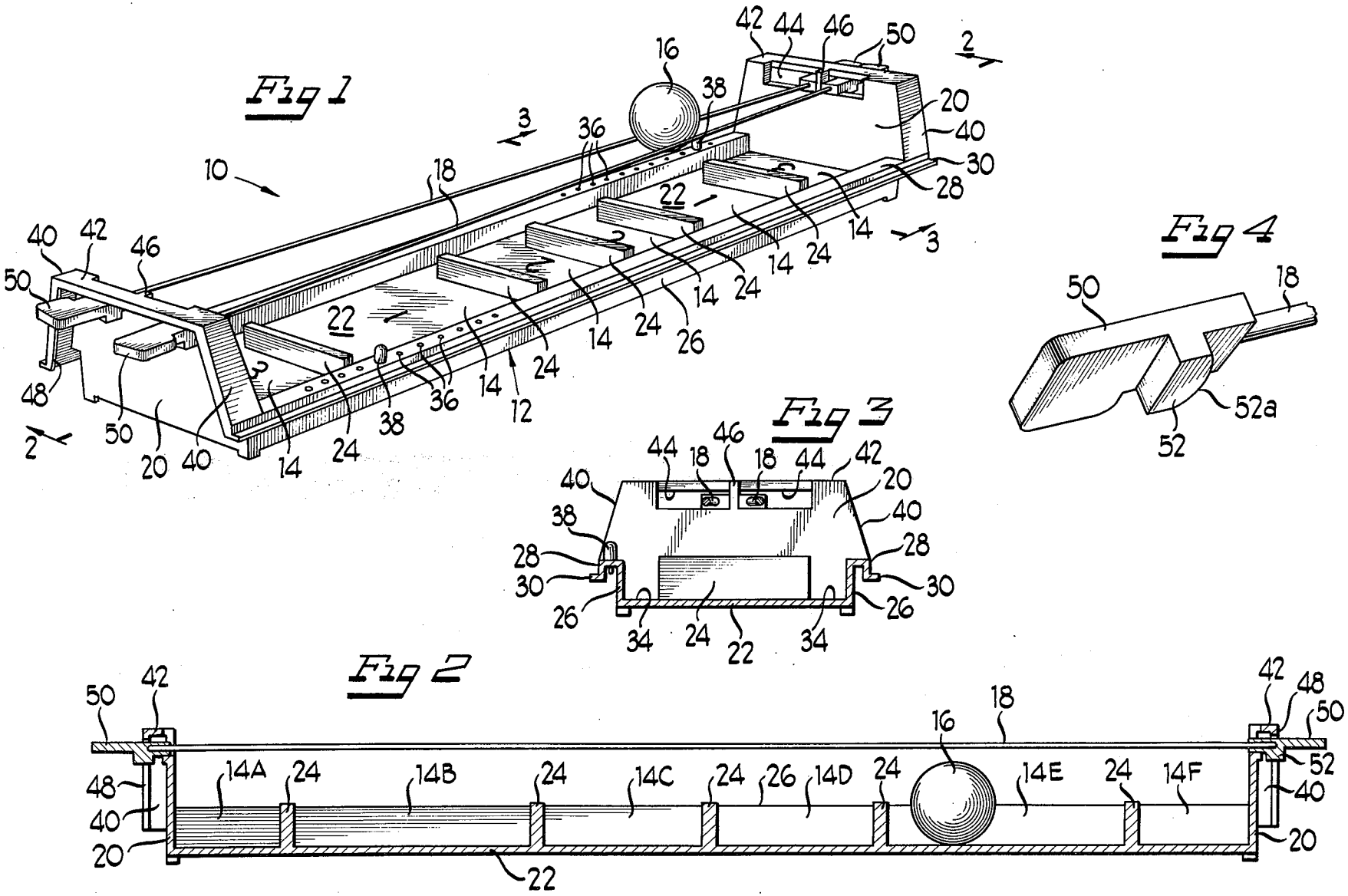
FIG. 1 is a perspective view of the present invention showing the playing ball elevated above the base and rollably supported by the playing rods.
FIG. 2 is a sectional view, on an enlarged scale, taken along line 2—2 of FIG. 1, showing the playing ball deposited within a receptacle in the playing base.
FIG. 3 is a sectional view, on an enlarged scale, taken generally along line 3—3 of FIG. 1.
FIG. 4 is a perspective view of a handle attached to one end of a playing rod.

The game device of this invention, generally designated 10, comprises a generally rectangular base portion 12 including a plurality of receptacles 14 (FIG. 1) designed to retain a playing ball 16. The playing ball 16 is rollably supported and guided above the base 12 by a pair of spaced rods or rails 18. Two walls 20, disposed at the ends of the playing base 12, movably support the rods 18 which pass through slots 44 therein. The spacing between the rods 18 can be varied by the players to be less than the diameter of the ball 16, whereby the rods will support the ball. As the space between the rods 18 is changed by the players, momentum can be imparted to the ball in either direction so that the ball moves to an advantageous position over designated receptacles at which time it can be dropped by increasing the spacing between the rods 18 to more than the diameter of the ball.

The base 12 includes an elongated rectangular flat frame 22. The frame 22 is divided into a number of receptacles 14 by a series of transverse short partitions 24 which lie perpendicular to the side walls 26. These receptacles can contain the ball 16 within the playing area. The side walls 26 include a U-shaped channel member 28 with an outwardly extending flange 30, all for strengthening purposes. As can be seen in FIG. 3, a space designated 34 separates the ends of the partitions 24 and the side walls 26.

Two scorekeeping means are disposed along the top of the channel 28 adjacent the right and lefthand ends, as viewed in FIG. 1, of the walls 26. Each includes a plurality of holes 36. Pegs 38 are inserted into the holes 36 to keep score.

The end walls 20 have downwardly tapering vertical side flanges 40 extending outwardly therefrom to meet the side walls 26. An upper flange 42, also connected to the end walls 20, extends outwardly and forms a bridge between the uppermost edges of the side walls 40. An elongated generally rectangular aperture 44 is disposed within the end wall 20 adjacent the bridge 42. A divider 46 separates the aperture 44 into two equal openings. A rib 48 extends inwardly from the edges of the walls 40 and 42 to reinforce the whole structure.

As previously stated, the pair of rods 18 extends between the walls 20. A handle 50 (see FIG. 4) is attached to the end of each of the rods 18. The handles 50 are designed to allow the players to easily move the rods 18 laterally with respect to the base 12 while only allowing a limited longitudinal movement. Thus each handle is provided with a downwardly extending stop 52 having a curved inner face **52*a* which is designed to abut the outside of wall 20 adjacent the apertures 44 when the end of the handle 58 is fully through the aperture 44**.

Referring to FIGS. 2 and 3, each player plays from one end of the frame 22 and the receptacles 14 vary in size and corresponding score value according to the distance from their respective players. This allows for a difficulty factor so that different receptacles are rated for different scores. The receptacles preferably are coded (e.g., color) for the opposing players. For instance, referring to FIG. 2, receptacles 14A, 14D and 14E could be color coded for the player playing at the left end of the device. Likewise, receptacles 14B, 14C and 14F could be color coded for the player playing at the right end of the device.

The present game requires agility, quick-wittedness and thinking in a competitive environment to successfully play the game since each player will try to control the roll of the ball so as to drop it in one of his receptacles, hopefully the highest score receptacle.

The foregoing detailed description has been given for clearness of understanding only and no unnecessary limitations should be understood therefrom as some modifications will be obvious to those skilled in the art.

I claim:

1. A game device, comprising:

a base including score indicating means;

a pair of rods movably supported on said base above the score indicating means, both ends of each of said rods being movable laterally with respect to each other and said base; and a movable playing object adapted to be supported by said rods or by said base, whereby said playing object can be moved in a direction longitudinally along said rods or be dropped onto said base in score indicating relationship to said score indicating means as a player of the game at each adjacent end of said rods attempts to control the movement of the rods and thus the movement of said object and to determine when it will drop onto said base to score.

2. The game device of claim 1 wherein said playing object is a ball.

3. The game device of claim 1 wherein said score indicating means is a plurality of receptacles on said base and said playing object is adapted to drop into one of said receptacles to score.

4. The game device of claim 1 wherein said playing object is a ball, said score indicating means is a plurality of receptacles on said base, and said ball is adapted to drop into one of said receptacles to score.

5. The game device of claim 1 including a handle on each end of each of said rods.

6. The game device of claim 5 wherein said base is rectangular and elongated in shape, said rods are supported on said base by a pair of upstanding members located adjacent the ends of said base, said upstanding members having apertures therein through which said rods pass and said handles having downwardly extending stops designed to abut the outward side of said upstanding members adjacent the apertures whereby the longitudinal movement of said rods is limited.

7. The game device of claim 1 including means to limit the longitudinal movement of said rods.

8. The game device of claim 1 wherein said rods are supported on said base in a horizontal disposition.

9. A game device comprising:

an elongated base including a plurality of scoring receptacles on top of the base and a pair of upstanding members located adjacent the ends of the base, said upstanding members having apertures therein;

a pair of rods supported by said upstanding members above said scoring receptacles, the end of said rods passing through the apertures in said upstanding members, said rods having handles at each end thereof, said handles having downwardly extending stops to abut the outward side of said upstanding members adjacent the apertures whereby the longitudinal movement of said rods is limited, both ends of each of said rods being movable laterally relative to said base; and a ball adapted to be supported by said rods or in said receptacles whereby a player selectively moving said rods propels said ball in a direction along said rod or drops said ball into one of said receptacles to score.

10. The game device of claim 9 wherein said rods are supported on said base in a horizontal disposition.

* * * * *